US007908670B2

(12) United States Patent
Semba et al.

(10) Patent No.: US 7,908,670 B2
(45) Date of Patent: Mar. 22, 2011

(54) EXERCISE GARMENT

(75) Inventors: Takayuki Semba, Kyoto (JP); Chizuru Fukuyo, Kyoto (JP); Nozomu Seike, Kyoto (JP); Hiroshi Kouno, Tokyo (JP)

(73) Assignee: Wacoal Corp., Kyoto-shi, Kyoto (JP)

( * ) Notice: Subject to any disclaimer, the term of this patent is extended or adjusted under 35 U.S.C. 154(b) by 424 days.

(21) Appl. No.: 11/720,112

(22) PCT Filed: Dec. 26, 2006

(86) PCT No.: PCT/JP2006/325925

§ 371 (c)(1),
(2), (4) Date: May 24, 2007

(87) PCT Pub. No.: WO2008/078392

PCT Pub. Date: Jul. 3, 2008

(65) Prior Publication Data

US 2009/0265828 A1 Oct. 29, 2009

(51) Int. Cl.
*A41D 13/00* (2006.01)
*A41B 1/00* (2006.01)

(52) U.S. Cl. ..... 2/69; 2/115

(58) Field of Classification Search ..... 2/69, 115, 2/94, 67; 482/124; 602/19, 20
See application file for complete search history.

(56) References Cited

U.S. PATENT DOCUMENTS 2,568,304 A * 9/1951 Schoenbrun ..... 119/770
2,986,740 A * 6/1961 Schudson ..... 2/115
4,273,216 A * 6/1981 Weissmann ..... 182/3
4,273,328 A * 6/1981 Ozbey et al. ..... 482/124
4,698,847 A * 10/1987 Yoshihara ..... 2/69
4,731,882 A * 3/1988 Ekman ..... 2/69
4,910,802 A * 3/1990 Malloy ..... 2/69
4,911,439 A * 3/1990 Kuhl ..... 482/124
4,946,453 A * 8/1990 Monson ..... 604/312

(Continued)

FOREIGN PATENT DOCUMENTS

JP 11-256404 A 9/1999

(Continued)

OTHER PUBLICATIONS

Notification of Transmittal of Translation of the International Preliminary Report on Patentability mailed Jul. 9, 2009.

*Primary Examiner* — Alissa L Hoey
(74) *Attorney, Agent, or Firm* — Leydig, Voit & Mayer, Ltd.

(57) ABSTRACT

An exercise garment according to which the exercise performance in various types of exercise accompanied by rotation of the trunk and movement of the arms can be sufficiently improved. The exercise garment includes first tightening portions exerting tightening forces on the scapulae and scapula-surrounding muscle groups, so that the scapulae and the scapula-surrounding muscle groups are supported such that the extent of mobility of the scapulae is broadened. The tightening force due to one of the first tightening portions is transmitted to the other first tightening portion via second tightening portions. As a result, movement of one scapula linked to the movement of the other scapula is promoted, and the extent of mobility of the scapulae is further broadened. Consequently, the flexibility around the shoulders during exercise in which the left and right shoulders are working together can be effectively increased.

4 Claims, 11 Drawing Sheets

U.S. PATENT DOCUMENTS

| | | | | |
|---|---|---|---|---|
| 4,953,856 | A * | 9/1990 | Fox, III | 482/105 |
| 4,993,705 | A * | 2/1991 | Tolle | 482/124 |
| 5,046,194 | A * | 9/1991 | Alaniz et al. | 2/69 |
| 5,149,099 | A * | 9/1992 | Radakovich | 473/208 |
| 5,201,074 | A * | 4/1993 | Dicker | 2/70 |
| 5,282,277 | A * | 2/1994 | Onozawa | 2/69 |
| 5,306,222 | A * | 4/1994 | Wilkinson | 482/124 |
| 5,367,708 | A * | 11/1994 | Fujimoto | 2/22 |
| 5,451,060 | A * | 9/1995 | Dalbo | 473/215 |
| 5,518,481 | A * | 5/1996 | Darkwah | 482/126 |
| 5,542,123 | A * | 8/1996 | DiPietro | 2/80 |
| 5,570,472 | A * | 11/1996 | Dicker | 2/69 |
| 5,699,559 | A * | 12/1997 | Sano | 2/67 |
| 5,792,034 | A * | 8/1998 | Kozlovsky | 482/124 |
| 5,823,851 | A * | 10/1998 | Dicker | 450/2 |
| 5,829,058 | A * | 11/1998 | Dicker et al. | 2/69 |
| 5,857,947 | A * | 1/1999 | Dicker et al. | 482/124 |
| 5,867,827 | A * | 2/1999 | Wilkinson | 2/69 |
| 5,896,578 | A * | 4/1999 | Hunter et al. | 2/2.15 |
| 5,937,442 | A * | 8/1999 | Yamaguchi et al. | 2/69 |
| 5,960,474 | A * | 10/1999 | Dicker et al. | 2/69 |
| 6,231,488 | B1 * | 5/2001 | Dicker et al. | 482/124 |
| 6,240,564 | B1 * | 6/2001 | Te Kanawa | 2/115 |
| 6,287,242 | B1 * | 9/2001 | Fray | 482/121 |
| 6,698,026 | B2 * | 3/2004 | Schweer | 2/94 |
| 6,892,396 | B2 * | 5/2005 | Uno et al. | 2/115 |
| 6,968,809 | B2 * | 11/2005 | Reardon | 119/770 |
| 7,074,204 | B2 * | 7/2006 | Fujii et al. | 602/75 |
| 7,089,597 | B2 * | 8/2006 | Horii et al. | 2/69 |
| 7,117,538 | B2 * | 10/2006 | Bosne et al. | 2/93 |
| 7,134,969 | B2 * | 11/2006 | Citron et al. | 473/277 |
| D539,512 | S * | 4/2007 | Ota et al. | D2/844 |
| 7,374,523 | B2 * | 5/2008 | Weir et al. | 482/148 |
| 2002/0062510 | A1 * | 5/2002 | Mullen | 2/69 |
| 2002/0078485 | A1 * | 6/2002 | Ferreiro | 2/69 |
| 2004/0000002 | A1 * | 1/2004 | Hollander | 2/69 |
| 2004/0133959 | A1 * | 7/2004 | Horii et al. | 2/69 |
| 2004/0255358 | A1 * | 12/2004 | Ota et al. | 2/69 |
| 2005/0197607 | A1 * | 9/2005 | Brown | 602/19 |
| 2006/0101553 | A1 * | 5/2006 | Aspray | 2/69 |
| 2006/0129076 | A1 * | 6/2006 | Haneda | 602/19 |
| 2007/0271671 | A1 * | 11/2007 | Okajima | 2/69 |
| 2007/0294801 | A1 * | 12/2007 | Furgerson et al. | 2/115 |
| 2008/0076645 | A1 * | 3/2008 | Brown | 482/124 |
| 2008/0319365 | A1 * | 12/2008 | Kendrick | 602/19 |
| 2009/0062704 | A1 * | 3/2009 | Brown et al. | 602/19 |
| 2010/0050313 | A1 * | 3/2010 | Shackelford, Jr. | 2/69 |
| 2010/0077527 | A1 * | 4/2010 | Lee et al. | 2/69 |

FOREIGN PATENT DOCUMENTS

| | | | |
|---|---|---|---|
| JP | 2002-302810 | A | 10/2002 |
| JP | 2004-44070 | A | 2/2004 |
| JP | 2004-263362 | A | 9/2004 |
| JP | 2005-248391 | A | 9/2005 |
| JP | 2006-291399 | A | 10/2006 |

* cited by examiner

*Fig.8*

| | COMPARATIVE EXAMPLE | WORKING EXAMPLE |
|---|---|---|
| A | 39.27 | 41.47 |
| B | 21.56 | 22.99 |
| C | 24.82 | 27.13 |
| D | 36.28 | 37.69 |
| Ave. | 30.48 | 32.32 |

UNITS: °

Fig.11

1. TAKE BACK EASIER

| COMPARATIVE EXAMPLE | NEITHER | WORKING EXAMPLE |
|---|---|---|
| 0 PERSONS | 2 PERSONS | 8 PERSONS |

2. SHOULDER ROTATION EASIER

| COMPARATIVE EXAMPLE | NEITHER | WORKING EXAMPLE |
|---|---|---|
| 0 PERSONS | 3 PERSONS | 7 PERSONS |

3. MORE COMFORTABLE TO WEAR

| COMPARATIVE EXAMPLE | NEITHER | WORKING EXAMPLE |
|---|---|---|
| 1 PERSONS | 1 PERSONS | 8 PERSONS |

EXERCISE GARMENT

CROSS-REFERENCE TO PRIOR APPLICATION

This is a U.S. national phase application under 35 U.S.C. §371 of International Patent Application No. PCT/JP2006/325925 filed Dec. 26, 2006, the content of which is incorporated herein in its entirety.

TECHNICAL FIELD

The present invention relates to an exercise garment that supports exercise of a wearer's upper body.

BACKGROUND ART

In recent years, exercise garments for improving exercise performance when doing sports and the like have become known. There are very deep-rooted needs on exercise garments. Taking golf as an example, there are evidently many users who wish to increase head speed and extend carry distance without doing daily strength training or stretching.

For such an exercise garment, tightening portions having a higher tightening force than a stretchable main body portion are formed in prescribed shapes on the main body portion. Tightening forces thus act on the skeleton/muscles along the tightening portions, whereby an exercise supporting function or taping function is achieved (see, for example, Patent Documents 1 to 3).

Patent Document 1: Japanese Patent Application Laid-open No. 2005-248391

Patent Document 2: Japanese Patent Application Laid-open No. 2004-263362

Patent Document 3: Japanese Patent Application Laid-open No. 2004-44070

DISCLOSURE OF THE INVENTION

Problem to be Solved by the Invention

With various types of sport and exercise such as the above-mentioned golf and also tennis, baseball, swimming and yoga, exercise of the scapulae accompanying rotation of the trunk and movement of the arms is carried out frequently. For example, in golf or tennis, when swinging a club or racket, right and left asymmetric exercise of the scapulae is carried out through rotation of the trunk, and in a yoga pose or the like, right and left symmetric exercise of the scapulae is carried out by moving both arms with right and left symmetry.

With such scapula exercise, it is usually the case that the left and right scapulae work together in the exercise rather than either the left or right scapula working independently. However, with each of the exercise garments described in Patent Documents 1 to 3, the wearer's upper body posture is merely corrected through the tightening portions, and sufficient consideration is not given to exercise in which the left and right scapulae work together. With these conventional exercise garments, it has thus been difficult to sufficiently improve the exercise performance in various types of exercise accompanied by rotation of the trunk and movement of the arms.

The present invention has been accomplished to resolve the above problem; it is an object of the present invention to provide an exercise garment according to which the exercise performance in various types of exercise accompanied by rotation of the trunk and movement of the arms can be sufficiently improved.

Means for Solving the Problem

To solve the above problem, an exercise garment according to the present invention, which is an exercise garment having an upper body portion constituted such as to fit a wearer's body, is characterized in that the upper body portion comprises a main body portion comprising a front body part and a back body part formed from a stretchable material, and band-like tightening portions having a higher tightening force than the main body portion, wherein the tightening portions comprise, on the back body part, a right and left pair of first tightening portions each formed in a closed loop such as to surround a scapula area of the wearer, and second tightening portions that join the first tightening portions together in positions corresponding to thoracic vertebrae of the wearer.

In this exercise garment, each of the right and left pair of first tightening portions is formed in a closed loop such as to surround one of the wearer's scapulae. The first tightening portions thus act such as to promote movement of the muscles around the scapulae, and hence broaden the extent of mobility of the scapulae. Moreover, the first tightening portions are joined together by the second tightening portions in positions corresponding to the wearer's thoracic vertebrae. Consequently, the action of one of the first tightening portions is also exerted on the other first tightening portion, and hence linked to the movement of one scapula whose extent of mobility has been broadened by one of the first tightening portions, movement of the other scapula is promoted. With the exercise garment, the flexibility around the shoulders during exercise in which the left and right scapulae are working together can thus be increased, and hence the exercise performance in various types of exercise accompanied by rotation of the trunk and movement of the arms can be sufficiently improved.

The second tightening portions preferably join together the upper portions of the first tightening portions and join together the lower portions of the first tightening portions. If the tightening forces due to the second tightening portions are applied excessively to the first tightening portions, then scapula movement may be impaired. The second tightening portions thus join together both the upper portions of the first tightening portions and the lower portions of the first tightening portions, whereby the tightening forces due to the second tightening portions can be prevented from becoming excessive, and hence flexibility around the shoulders during exercise in which the left and right shoulders are working together can be secured.

Moreover, the tightening portions preferably further comprise, on the back body part, a right and left pair of third tightening portions each of which is joined to a portion of one of the first tightening portions outside a scapula area of the wearer, and extends along a latissimus dorsi to the wearer's waist, and on the front body part, a right and left pair of fourth tightening portions each of which extends from an upper portion of a trapezius of the wearer along the outside of a pectoralis major and along an external oblique abdominis to the wearer's abdomen. In this way, the working together of the scapulae and a lower portion of the trunk can be improved by the third tightening portions and the fourth tightening portions. As a result, the extent of mobility of the scapulae is further broadened, and hence the function of improving the flexibility around the shoulders during exercise in which the left and right scapulae are working together can be further strengthened.

Moreover, each of the first to fourth tightening portions preferably has a width within a range from 2 to 4 cm. In this case, the wearer's scapulae can be firm-fly supported by the tightening portions, and hence loads can be transmitted to the muscles around the scapulae suitably. Moreover, the tightening portions do not dig into the scapulae or body, and hence good comfort is secured.

EFFECTS OF THE INVENTION

According to the exercise garment of the present invention, exercise performance in various types of exercise accompanied by rotation of the trunk and movement of the arms can be sufficiently improved.

BRIEF DESCRIPTION OF THE DRAWINGS

FIG. 8 A table showing adduction angle measurement results.

FIG. 11 Tables showing monitors' responses regarding comfort of the exercise garment.

EXPLANATION OF REFERENCE NUMERALS

1, 40: exercise garment, 10: main body portion, 11: front body part, 12: back body part, 20: tightening portion, 21: first tightening portion, 22: second tightening portion, 23: third tightening portion, 24: fourth tightening portion

BEST MODE FOR CARRYING OUT THE INVENTION

Following is a detailed description of preferred embodiments of an exercise garment according to the present invention, with reference to the drawings.

Figure 1:
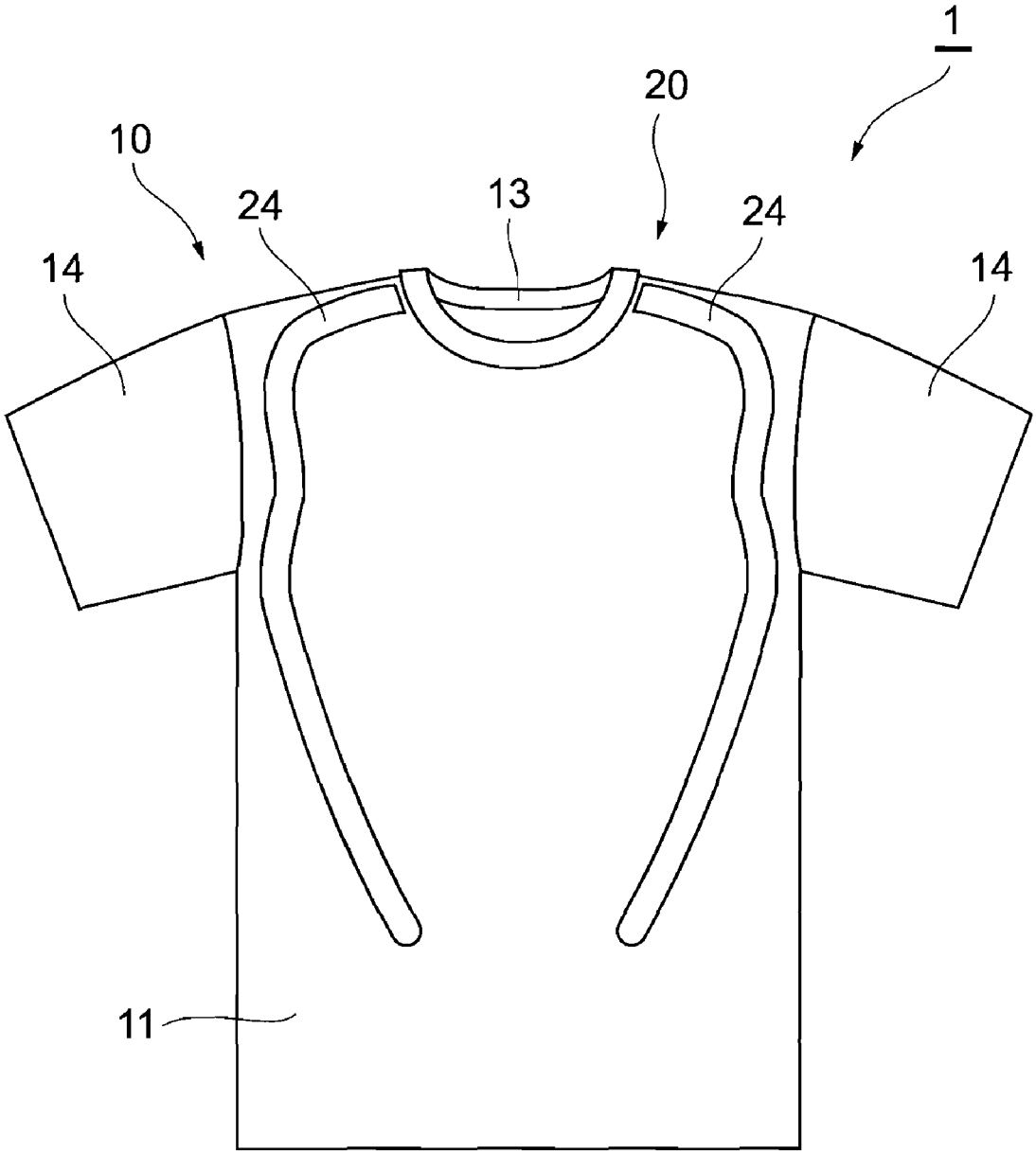
FIG. 1 A view from the front of an exercise garment according to an embodiment of the present invention.
Figure 2:
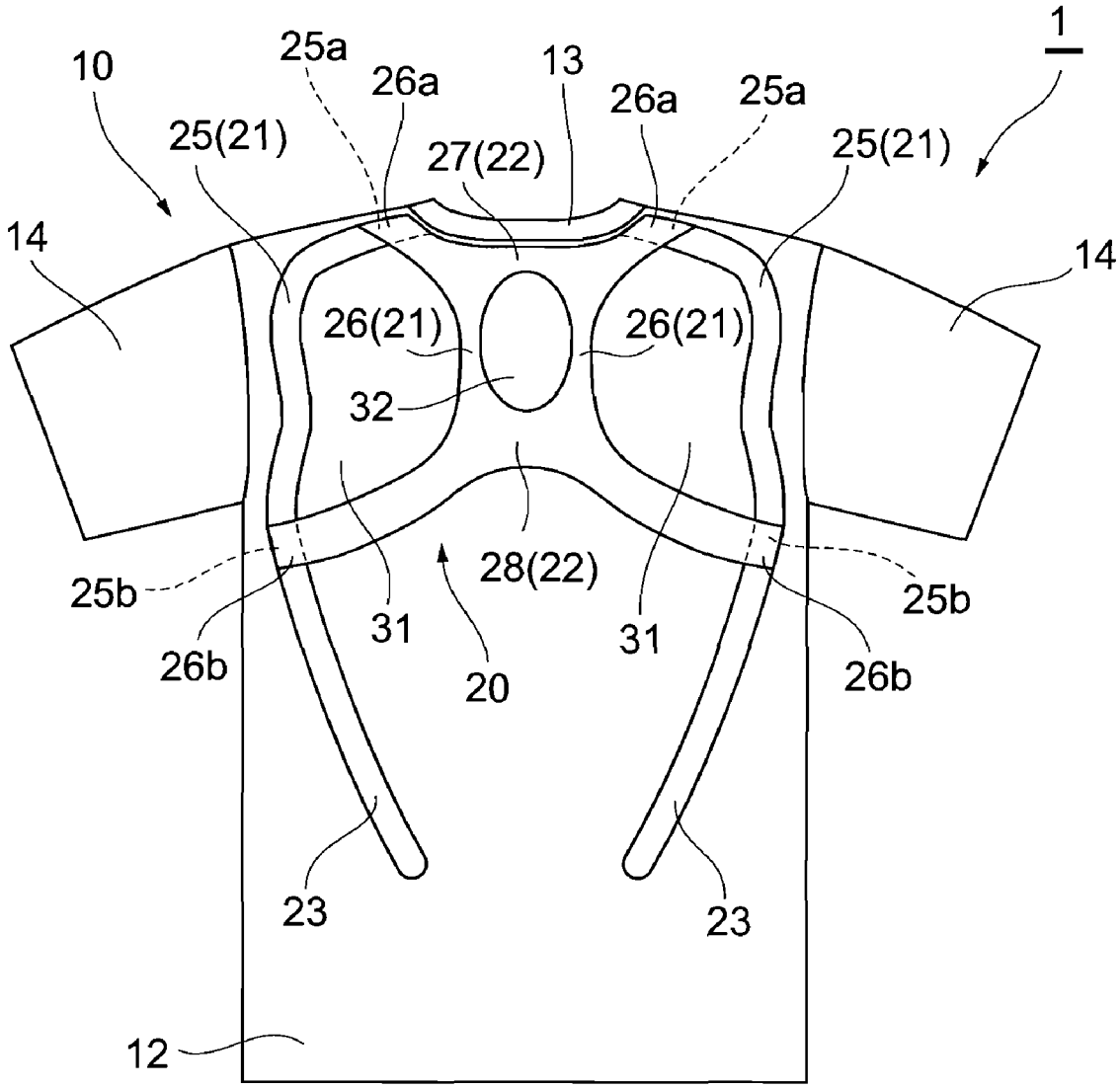
FIG. 2 A view from the back of the exercise garment shown in FIG. 1.
Figure 3:
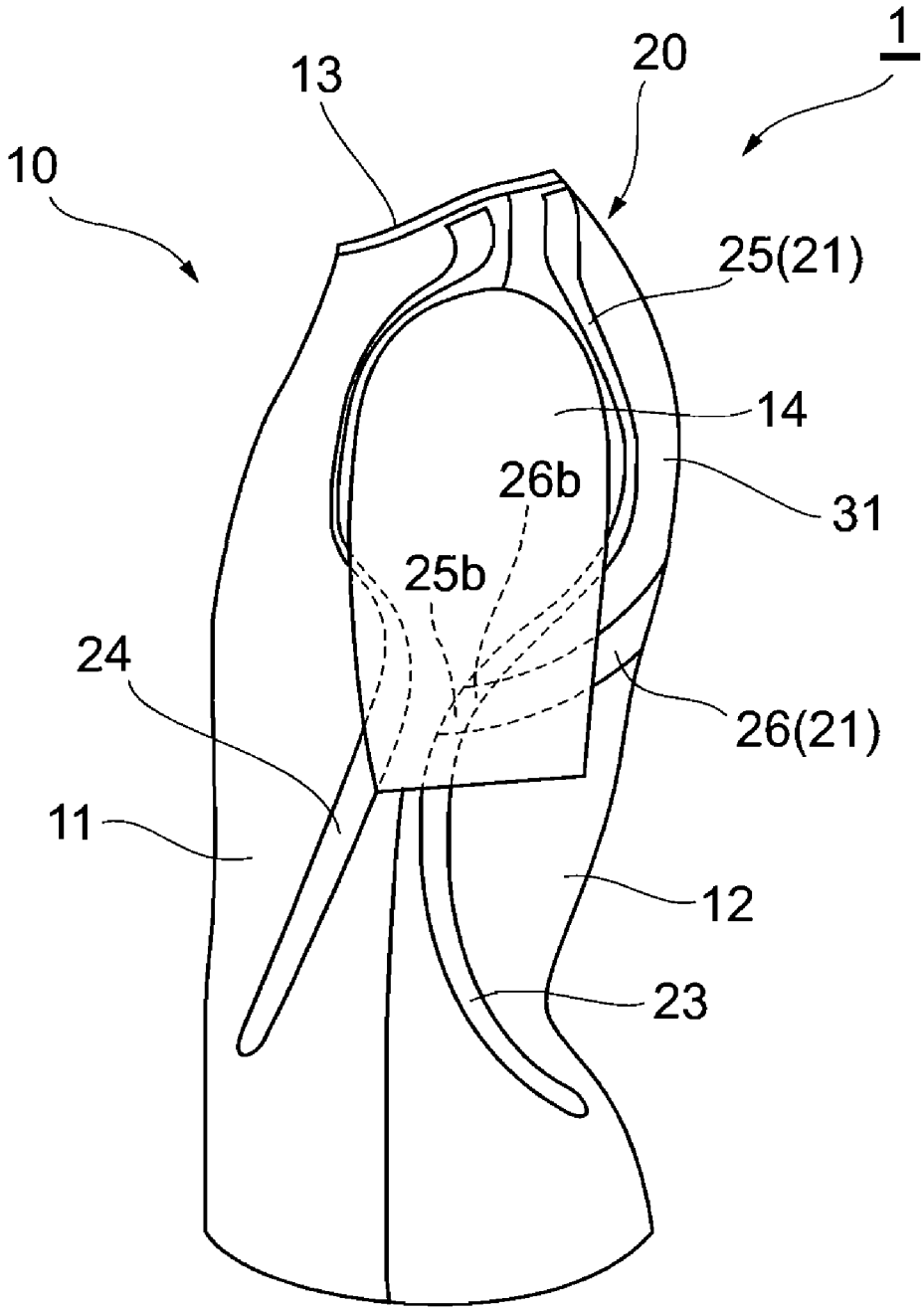
FIG. 3 A view from the side of the exercise garment shown in FIG. 1.

FIG. 1 is a view from the front of an exercise garment according to an embodiment of the present invention. Moreover, FIG. 2 is a view from the back of the exercise garment shown in FIG. 1, and FIG. 3 is a view from the side thereof. The exercise garment 1 shown in FIGS. 1 to 3 is a short-sleeved shirt worn as golf-ware with an object of extending the ball carry distance when, for example, a golfer is practicing or playing on a course.

The exercise garment 1 comprises a main body portion 10 that is in close contact with the wearer's upper body, and band-like tightening portions 20 that are sewn onto an outer surface of the main body portion 10. The main body portion 10 is constituted from a front body part 11, a back body part 12, a collar portion 13, and sleeve portions 14, thus forming an upper body portion that fits the wearer's body. The front body part 11 and the back body part 12 are sewn together along sewing lines L1 on sides of the main body portion 10. The collar portion 13 is sewn to the front body part 11 and the back body part 12 along a sewing line L2 running around the neck. Moreover, each of the sleeve portions 14 is sewn to the front body part 11 and the back body part 12 along a sewing line L3 running around an arm.

As the material constituting the main body portion 10, a stretchable material is used. As such a material, for example a bare plain stitch knitted fabric of nylon mixed fiber percentage 95% and polyurethane mixed fiber percentage 5% can be used. In this case, there is good close contact of the exercise garment 1 to the wearer. Moreover, such a bare plain stitch knitted fabric has higher stretchability than an ordinary plain stitch knitted fabric, and hence even though the degree of close contact to the wearer is high, there is virtually no impairment of movement.

Meanwhile, the tightening portions 20 are constituted from first tightening portions 21, second tightening portions 22, and third tightening portions 23 formed on the back body part 12, and fourth tightening portions 24 formed on the front body part 11. The first to fourth tightening portions 21 to 24 each cause a tightening force to act, whereby the first to fourth tightening portions 21 to 24 have a function of supporting assigned portions of the wearer's muscles/skeleton. The tightening portions 20 are formed, for example, by sewing a satin power net of nylon mixed fiber percentage 66%, polyurethane mixed fiber percentage 10%, and cotton mixed fiber percentage 24% onto the main body portion 10.

Note that instead of being sewn onto the main body portion 10, the tightening portions 20 may be formed by being stuck onto the main body portion 10, or may be formed by being joined to the main body portion 10. Alternatively, the tightening portions 20 may be formed integrally with the main body portion 10 by changing the knit of the main body portion 10, or applying on a resin such as a urethane.

Figure 4:
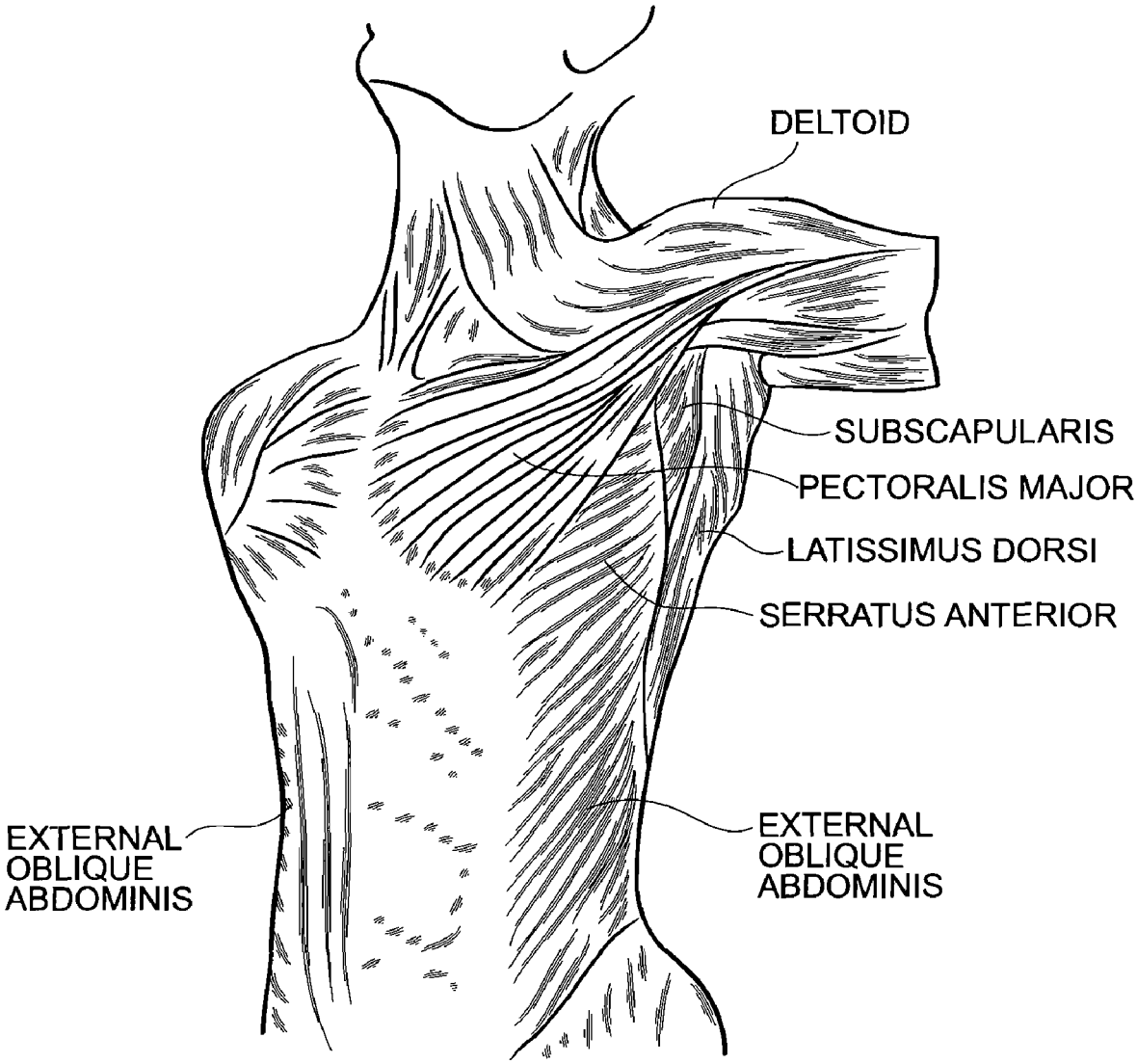
FIG. 4 A view from the front showing human muscle groups.

Here, before describing the first to fourth tightening portions 21 to 24, the main bones/muscles on which the tightening forces therefrom act will be described. FIG. 4 is a view from the front showing human muscle groups, and FIG. 5 is a view from the back showing human muscle groups.

Figure 5:
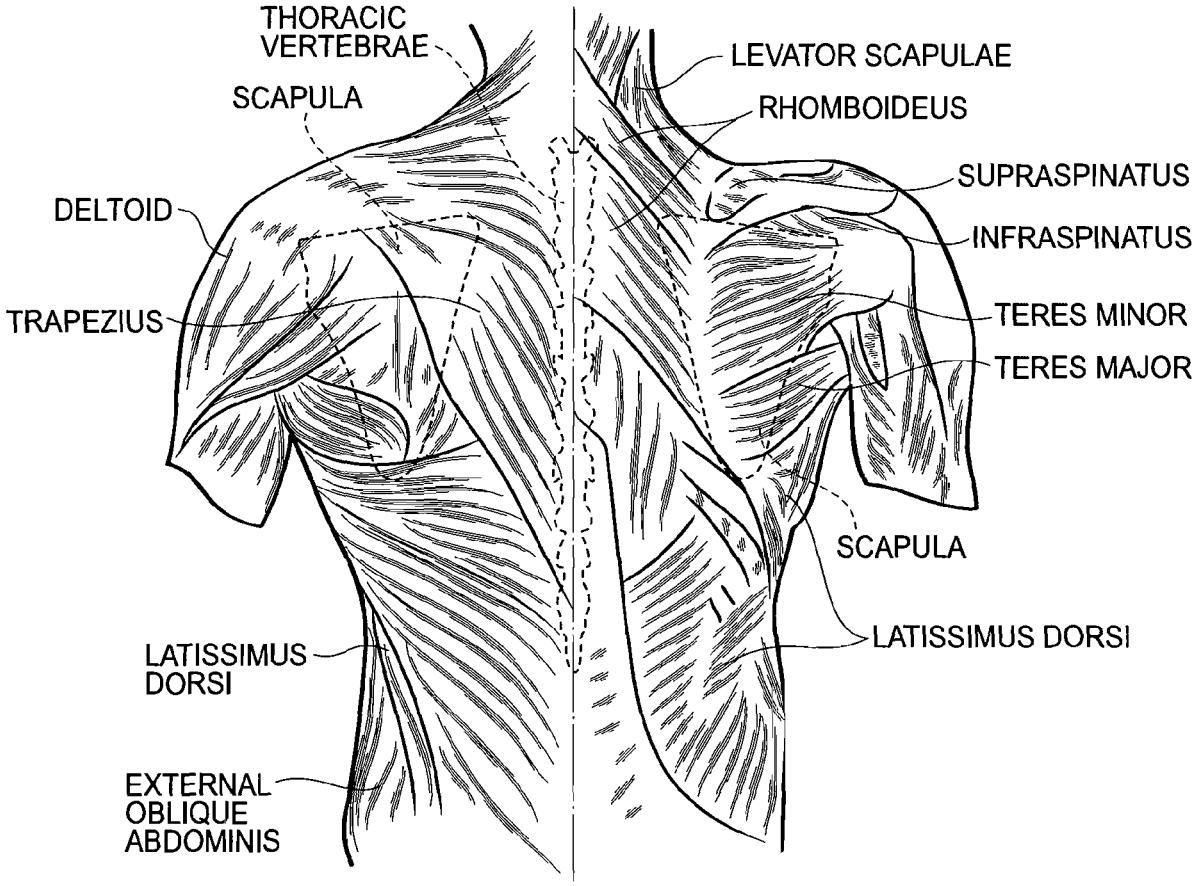
FIG. 5 A view from the back showing human muscle groups.

As shown in FIGS. 4 and 5, on the back of the human body around the shoulders are positioned a right and left pair of scapulae forming shoulder joints. Each scapula is positioned on the outside of the ribs in a state not fixed to the ribs, and hence can move up, down, left, and right along the form of the ribs. A total of ten types of muscle being the deltoid, the levator scapulae, the supraspinatus, the infraspinatus, the teres minor, the teres major, the subscapularis, the serratus anterior, the rhomboideus, and the trapezius (hereinafter these muscles are referred to collectively as the "scapula-surrounding muscle group") are primarily involved in mobility of each scapula. Moreover, in addition to the scapula-surrounding muscle group, the latissimus dorsi on the back of the trunk, and the pectoralis major and the external oblique abdominis on the front of the trunk are also involved in an auxiliary way.

The first tightening portions 21 are portions that support the scapulae and the scapula-surrounding muscle groups of the wearer, and are formed in a right and left pair as shown in FIG. 2. Each of the first tightening portions 21 is constituted from a first portion 25 that extends above and outside the scapula area, and a second portion 26 that extends inside and below the scapula area, having a closed loop overall that runs around the form of the scapula area. More specifically, when the exercise garment 1 is being worn, the first portion 25 extends from the vicinity of the wearer's neck above the scapula area, and moreover curves downward along the form of an angular portion of the scapula area, and extends along the outside of the scapula area. The width of the first portion 25 is approximately 2.5 cm along the whole thereof.

Meanwhile, when the exercise garment 1 is being worn, the second portion 26 extends from the vicinity of the wearer's neck along the inside of the scapula area, and moreover curves along the form of the inner edge of the scapula area, and extends below the scapula area. An upper end 26*a* of the second portion 26 is joined to an upper end 25*a* of the first portion 25 in the vicinity of the wearer's neck, and a lower end 26*b* of the second portion 26 is joined to a lower end 25*b* of the first portion 25 at a position to the outside of a lower end of the outer edge of the scapula area. The width of the second portion 26 is approximately 2.5 cm at a portion thereof inside the scapula area, and approximately 3.5 cm at a portion thereof below the scapula area.

Moreover, in a region on the inside of each closed looped first tightening portion 21 is provided a portion where the main body portion 10 is exposed (hereinafter each such portion is referred to as a "side hole 31"). These side holes 31 function as portions that regulate the tightening forces acting on the scapulae and the scapula-surrounding muscle groups. Note that as the material constituting the main body portion 10 at the portions corresponding to the side holes 31, a material having a lower tightening force than for other portions of the main body portion 10 may be used.

The second tightening portions 22 are portions that join the right and left pair of first tightening portions 21 together, and are formed in positions corresponding to the wearer's thoracic vertebrae. The second tightening portions 22 are constituted from a first portion 27 that joins the upper portions of the first tightening portions 21 together, and a second portion 28 that joins the lower portions of the first tightening portions 21 together, and are formed integrally with the second portions 26 of the first tightening portions 21.

More specifically, the first portion 27 curves gently downward following the shape of the collar portion 13, and joins together the second portions 26 of the first tightening portions 21 at approximately the upper half of the portion of each thereof inside the scapula area. Moreover, the second portion 28 curves upward with greater curvature than the first portion 27, and joins together the second portions 26 of the first tightening portions 21 at approximately the lower half of the portion of each thereof inside the scapula area.

Moreover, in a central portion between the second tightening portions 22 there is again provided a portion where the main body portion 10 is exposed (hereinafter this portion is referred to as the "center hole 32"). The center hole 32 is provided in a position corresponding to, for example, the wearer's third, fourth, and fifth thoracic vertebrae, and has a vertically long elliptical shape. The center hole 32 functions as a portion that regulates the tightening forces from the second tightening portions 22. Note that, as for the case of the side holes 31, as the material constituting the main body portion 10 at the portion corresponding to the center hole 32, a material having a lower tightening force than for other portions of the main body portion 10 may be used.

The third tightening portions 23 are portions that support a lower portion of the back of the wearer's trunk, and are formed in a right and left pair, each being integrated with the first portion 25 of one of the first tightening portions 21. Each of the third tightening portions 23 extends downward from the lower end 25*b* of the first portion 25 of the first tightening portion 21, extending along the wearer's latissimus dorsi to the wearer's waist. The width of each third tightening portion 23 is approximately 2.5 cm along the whole thereof.

The fourth tightening portions 24 are portions that support the front of the wearer's trunk, and are formed in a right and left pair on the front body part 11 as shown in FIG. 1. These fourth tightening portions 24 are formed in approximately the same positions as the first portions 25 of the first tightening portions 21 and the third tightening portions 23 on the front and back of the main body portion 10. Each fourth tightening portion 24 extends along an upper portion of the wearer's trapezium, and moreover curves in the vicinity of the shoulder joint, and extends along the outside of the pectoralis major and along the external oblique abdominis as far as the abdomen. The width of each fourth tightening portion 24 is approximately 2.5 cm along the whole thereof.

With the exercise garment 1, when the exercise garment 1 is being worn, tightening forces due to the first tightening portions 21 act on the scapulae and the scapula-surrounding muscle groups, so that when the wearer tries to carry out rotation of the trunk or movement of the arms, the scapulae and the scapula-surrounding muscle groups are supported such that the extent of mobility of the scapulae is broadened. At this time, because each of the first tightening portions 21 is formed in a closed loop such as to surround one of the scapulae, movement of the scapulae in all directions accompanying rotation of the trunk or movement of the arms can be supported.

Moreover, the tightening force due to one of the first tightening portions 21 is transmitted to the other first tightening portion 21 via the second tightening portions 22. As a result, linked to the movement of one scapula whose extent of mobility has been broadened by one of the first tightening portions 21, movement of the other scapula is promoted, and hence the extent of mobility of the scapulae is further broadened. Consequently, with the exercise garment 1, the flexibility around the shoulders during exercise in which the left and right scapulae are working together such as right and left asymmetric exercise of the scapulae arising through rotation of the trunk or right and left symmetric exercise of the scapulae arising through both arms being moved symmetrically with one another can be effectively increased. This achieves an improvement in various types of exercise performance such as club or racket swinging speed or swimming propulsion.

Moreover, with the exercise garment 1, latissimi dorsi positioned at a lower portion on the back of the trunk are supported by the third tightening portions 23. Here, because each of the third tightening portions 23 is joined to the lower end 25*b* of the first portion 25 of one of the first tightening portions 21, working together of the scapula-surrounding muscle groups and the latissimi dorsi can be improved through cooperation between the first tightening portions 21 and the third tightening portions 23. Furthermore, with the exercise garment 1, the pectoralis major muscles and the external oblique abdominis muscles positioned on the front of the trunk are also supported by the fourth tightening portions 24. Working together of the scapula-surrounding muscle groups, and the pectoralis major muscles and the external oblique abdominis muscles can thus be improved through cooperation between the first tightening portions 21 and the fourth tightening portions 24.

This improving of the working together between the scapula-surrounding muscle groups and the various muscles of the trunk is based on the following knowledge. That is, the scapulae predominantly have a function as balance sensors that keep the balance of the body, a support function of supporting the body, a function of producing propulsion when walking and so on, and a function as a foundation for the hands and arms. These functions are all intimately linked to movement of the trunk. Consequently, by improving the working together between the scapula-surrounding muscle groups and the various muscles of the trunk through the third tightening portions 23 and the fourth tightening portions 24, the extent of mobility of the scapulae can be further broadened. The effect of improving the exercise performance in various types of exercise accompanied by rotation of the trunk and movement of the arms can thus be strengthened. Note that as described above, with the exercise garment 1, tightening forces act on the scapula-surrounding muscle groups so as to promote movement thereof, and hence an effect of stiff shoulders of the wearer being prevented or relieved can also be expected.

It is thought that if the tightening forces due to the first tightening portions 21 act excessively on the scapula-surrounding muscle groups, then scapula movement may conversely be impaired. Moreover, for the second tightening portions 22, again it is thought that if the tightening forces therefrom act excessively, then right and left symmetrical scapula movement may conversely be impaired in the case of simultaneous adduction or abduction of the left and right scapulae.

To counteract this, the exercise garment 1 is a so-called three hole type exercise garment having the side holes 31 provided in two places inside the respective first tightening portions 21, and the center hole 32 provided in the central portion between the second tightening portions 22. By providing the side holes 31 in this way, the tightening forces due to the first tightening portions 21 are prevented from acting excessively on the scapulae, so that smooth scapula movement is secured. Moreover, by providing the center hole 32, the tightening forces from the second tightening portions 22 are eased, so that even for right and left symmetrical scapula mobility, smooth scapula movement is secured.

Moreover, with the exercise garment 1, the width of the tightening portions 20 is within a range from 2 to 4 cm along the whole thereof. In this case, the wearer's scapulae can be firm-fly supported by the tightening portions 20, and hence the tightening forces can be transmitted to the scapula-surrounding muscle groups suitably. Moreover, the tightening portions 20 do not dig into the scapulae or body, and hence good comfort is secured.

Figure 6:
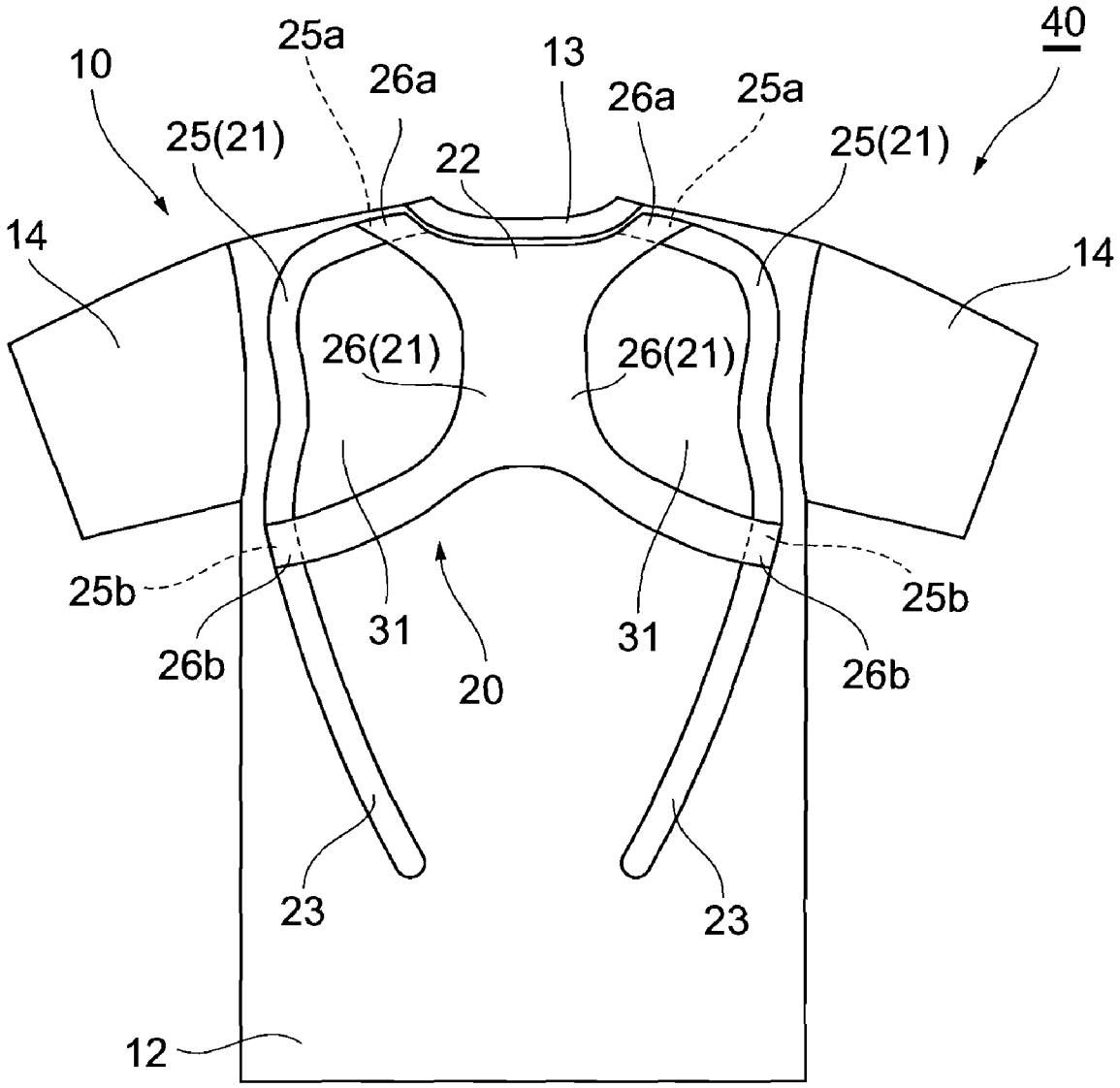
FIG. 6 A view from the back of an exercise garment according to a variation of the present invention.

Next, an exercise garment according to a variation of the present invention will be described. FIG. 6 is a view from the back of the exercise garment 40 according to the variation.

As shown in FIG. 6, the exercise garment 40 differs to the above embodiment which is a three hole type exercise garment having a center hole 32 provided in a central portion between second tightening portions 22 in that the exercise garment 40 is a so-called two hole type exercise garment in which such a center hole 32 is not provided in a central portion between second tightening portions 22. Other than this, the constitution is the same as in the above embodiment.

With this exercise garment 40, the second tightening portion 22 tightening force is higher than with the exercise garment 1, but as for the exercise garment 1, mobility of the scapulae in all directions accompanying rotation of the trunk or movement of the arms can be supported by the first tightening portions 21, and moreover the tightening force due to one of the first tightening portions 21 is transmitted to the other first tightening portion 21 via the second tightening portion 22. Consequently, for the exercise garment 40, again, the extent of mobility of the wearer's scapulae can be sufficiently broadened, and hence the flexibility around the shoulders during exercise in which the left and right scapulae are working together can be increased, and thus the exercise performance in various types of exercise accompanied by rotation of the trunk and movement of the arms can be improved.

Next, functionality test results for the exercise garments 1 and 40 described above will be described.

Figure 7:
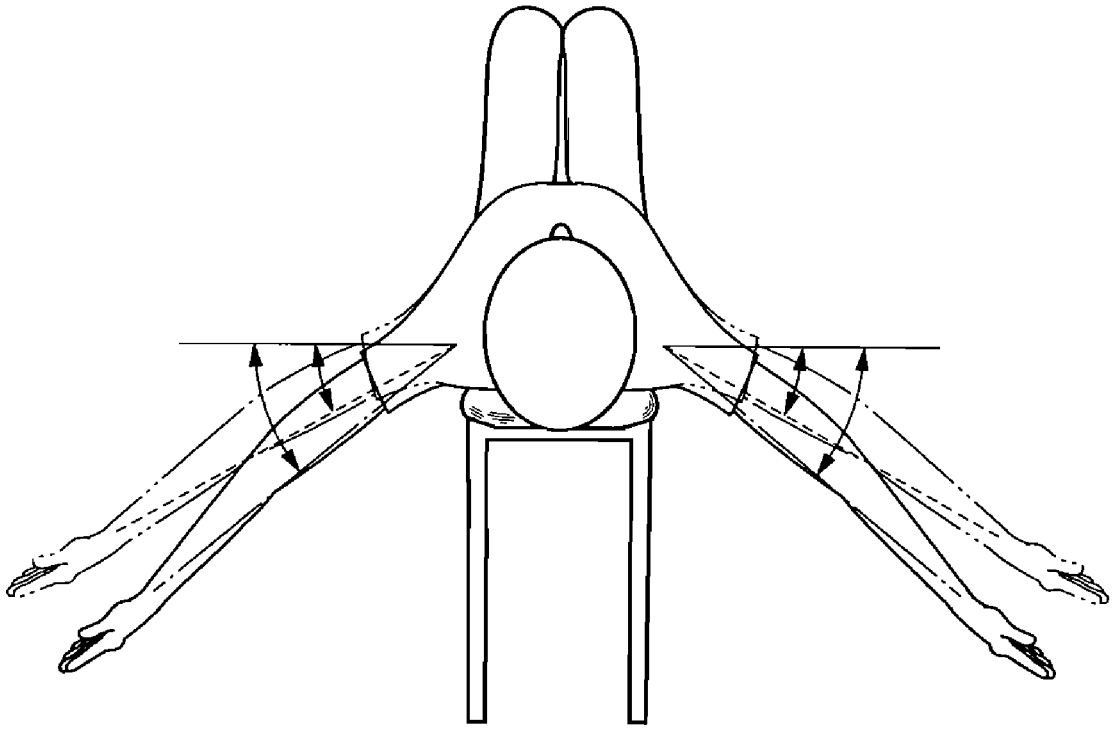
FIG. 7 A view showing adduction angle measurement.

In these functionality tests, first, as shown in FIG. 7, each of four monitors was made to carry out scapula adduction exercise in a posture lying face up on a bench, and it was measured to what angle the two arms bent back relative to horizontal (the adduction angle). Each monitor was made to wear a two hole type exercise garment like the exercise garment 40 as a working example, and was made to wear an ordinary exercise garment having no tightening portions as a comparative example.

FIG. 8 is a table showing the test results. As shown in FIG. 8, for all four of the monitors, the adduction angle was greater in the case of wearing the exercise garment according to the working example than in the case of wearing the exercise garment according to the comparative example. The adduction angle was increased by approximately 1.8° as an average over the four people. This means that, if a monitor's arm length is taken to be, for example, 65 cm, then each monitor could swing the tips of his arms back by approximately an extra 2 cm.

Next, to check the exercise performance improvement effect, ten monitors were made to perform a golf swing, and the posture during club take back and the head speed during the swing were measured. Each monitor was made to wear a three hole type exercise garment like the exercise garment 1 as a working example, and was made to wear an ordinary exercise garment having no tightening portions as a comparative example.

Figure 9:
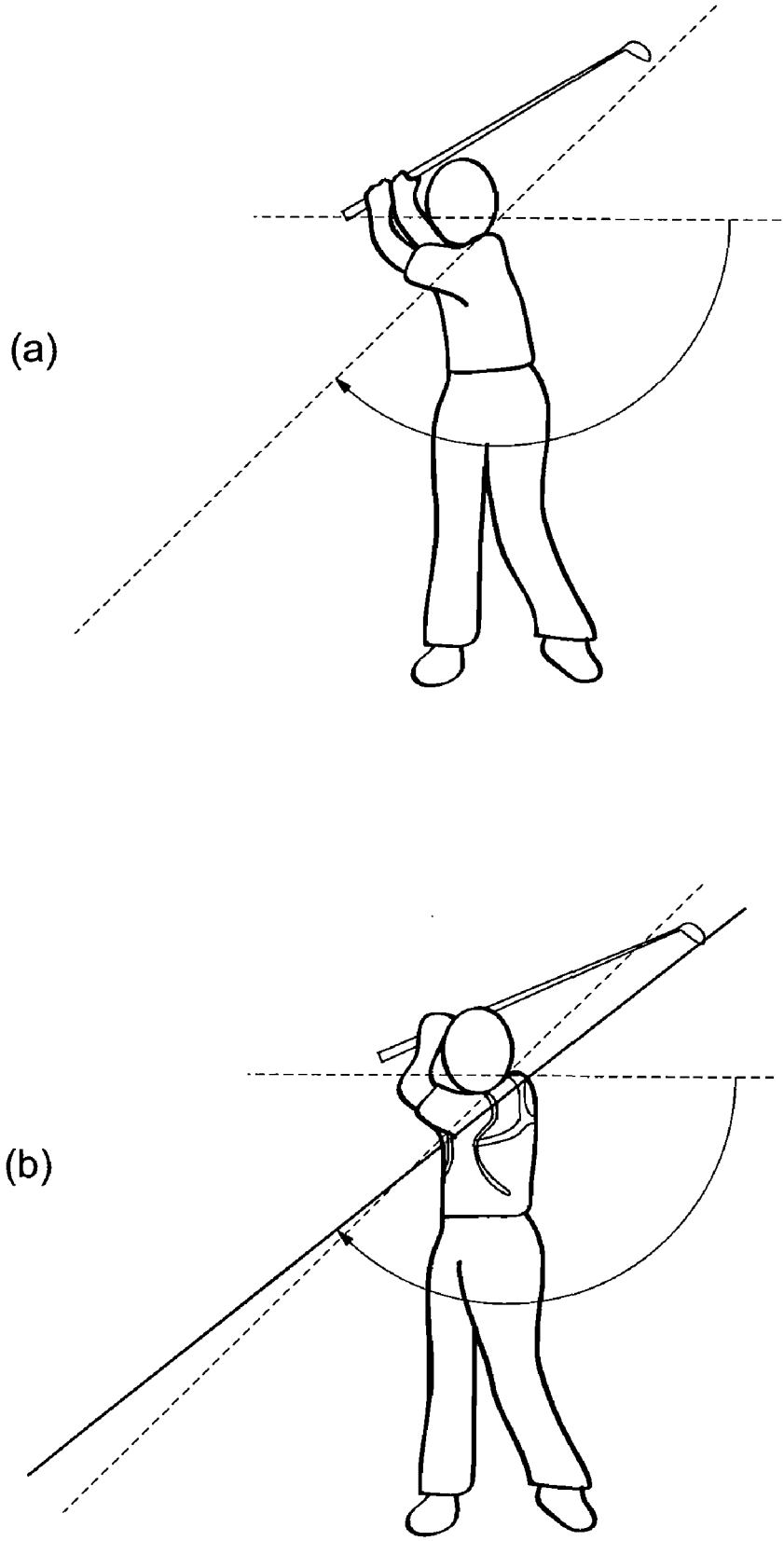
FIG. 9 Views showing the posture of a monitor during take back of a club.

FIG. 9 consists of views showing the posture of a monitor during club take back. As can be seen from FIG. 9, the area of the back visible during take back is greater in the case of wearing the exercise garment according to the working example than in the case of wearing the exercise garment according to the comparative example. It was thus confirmed that through the exercise garment according to the working example, the flexibility around the shoulders for each monitor is increased, and hence a greater take back can be taken.

Figure 10:
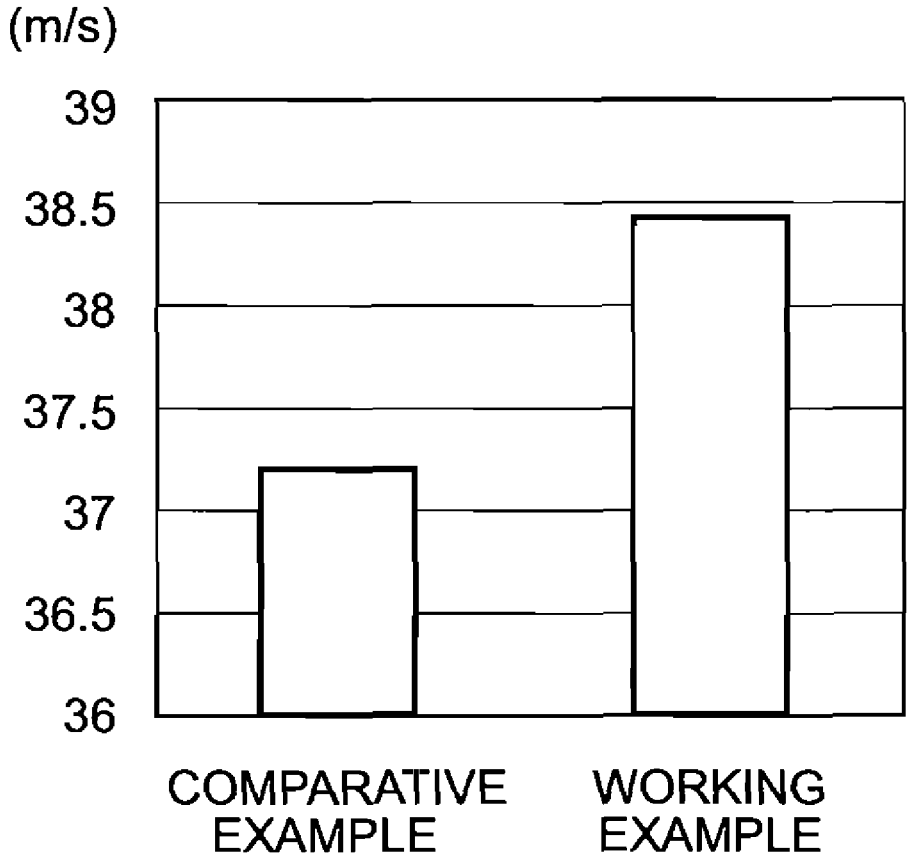
FIG. 10 A bar chart showing measurement results of head speed during a swing.

Moreover, FIG. 10 is a bar chart showing the measurement results of the head speed during the swing. From the measurements, it was found that the head speed was increased for nine of the ten monitors. As shown in FIG. 10, on average for the nine people for whom the head speed increased, the head speed was approximately 1.2 m/s higher in the case of wearing the exercise garment according to the working example than in the case of wearing the exercise garment according to the comparative example. Converting into the carry distance, this means an improvement of over 8 yards.

Furthermore, as shown in FIG. 11, regarding the comfort of the exercise garment, the following responses were obtained from the ten monitors: "take back is easier" (8 out of 10 monitors), "shoulder rotation is easier" (7 out of 10 monitors), and "more comfortable to wear" (8 out of 10 monitors).

From the above results, it was demonstrated that for the exercise garment 1 or 40, through the action of the first to fourth tightening portions 21 to 24, flexibility around the shoulders during exercise in which the left and right scapulae are working together is increased, and hence the exercise performance in various types of exercise accompanied by rotation of the trunk and movement of the arms is improved. Moreover, it was demonstrated that the exercise garment 1 or 40 has excellent comfort, there being no discomfort even upon wearing for a long time.

The present invention is not limited to the above embodiments. For example, with the exercise garment 1 or 40 described above, the tightening portions 20 are provided on the outside of the main body portion 10, but the tightening portions 20 may instead be provided on the inside of the main body portion 10. In this case, the tightening portions 20 are hidden on the side of the wearer's skin, and hence the exercise garment 1 or 40 can be made to look neater. Moreover, in the embodiments described above, a short-sleeved exercise garment was given as an example, but the exercise garment may be any garment having shoulder portions, for example may be long-sleeved or sleeveless.

The invention claimed is:

1. An exercise garment comprising an upper body portion constituted such as to fit a wearer's body, wherein said upper body portion comprises a main body portion comprising a front body part and a back body part formed from a stretchable material, and band-like tightening portions having a higher tightening force and stretch resistance than said main body portion, and said tightening portions comprise, on said back body part:

a right and left pair of first tightening portions each comprising, when the exercise garment is worn, an extension above and outside the wearer's scapula area and inside and below the scapula area of the wearer, formed in a closed loop without extending to the wearer's arms, the closed loop including an open region inside the closed loop, such as to surround the scapula area of the wearer; and second tightening portions that join said first tightening portions together in positions corresponding to thoracic vertebrae of the wearer, wherein the first and second tightening portions support the wearer's scapulae and scapula-surrounding muscle groups such that the extent of mobility of the scapulae is broadened.

2. The exercise garment according to claim 1, wherein the first tightening portions have upper portions and lower portions and said second tightening portions join together the upper portions of said first tightening portions and join together the lower portions of said first tightening portions.

3. The exercise garment according to claim 1, wherein said tightening portions further comprise:

on said back body part, a right and left pair of third tightening portions each of which is joined to a portion of one of said first tightening portions outside a scapula area of the wearer, and extends along a latissimus dorsi area to the wearer's waist area; and on said front body part, a right and left pair of fourth tightening portions each of which extends from an upper portion of a trapezius area of the wearer along the outside of a pectoralis major area and along an external oblique abdominis area to the wearer's abdomen area.

4. The exercise garment according to claim 3, wherein each of said first to fourth tightening portions has a width within a range from 2 to 4 cm.

* * * * *